US005575021A

United States Patent [19]

Harris

[11] Patent Number: 5,575,021

[45] Date of Patent: Nov. 19, 1996

[54] COMBINED TOILET TRAINER AND TOY CAR

[76] Inventor: Rosalind M. Harris, 24442 Kinsel, Southfield, Mich. 48034

[21] Appl. No.: 564,865

[22] Filed: Nov. 30, 1995

[51] Int. Cl.[6] ..... A47K 11/00

[52] U.S. Cl. ..... 4/449; 4/479; 4/902

[58] Field of Search ..... 4/449, 458, 902, 4/314, 479, 661

[56] References Cited

U.S. PATENT DOCUMENTS

| | | | |
|---|---|---|---|
| D. 310,118 | 8/1990 | Lemon | D23/297 |
| D. 320,845 | 10/1991 | Lambdin | D23/297 |
| D. 321,046 | 10/1991 | Lambdin | D23/297 |
| D. 321,246 | 10/1991 | Lambdin | D23/297 |
| 2,663,861 | 12/1953 | Heath | 4/902 |
| 3,364,478 | 1/1968 | Waard | 4/449 |
| 3,691,980 | 9/1972 | Shastal | 4/902 |
| 5,083,325 | 1/1992 | Vltullo | 4/479 |
| 5,369,820 | 12/1994 | Blount | 4/902 |

FOREIGN PATENT DOCUMENTS

| | | | |
|---|---|---|---|
| 2617035 | 12/1988 | France | 4/449 |
| 3640897 | 6/1988 | Germany | 4/449 |
| 8400591 | 9/1985 | Netherlands | 4/449 |

*Primary Examiner*—Renee S. Luebke
*Assistant Examiner*—Charles R. Eloshway
*Attorney, Agent, or Firm*—Joseph N. Breaux

[57] ABSTRACT

A combined toilet trainer and toy car is provided of the type having a body constructed to resemble an automobile and ridable by a child and the body carrying a removable pan which activates a horn and lights when a child uses the pan as a toilet. The combined toilet trainer and toy car comprises: a body having a pair of side walls, a top wall, a front wall and a rear wall formed in the shape of an automobile, the top wall forming a hole therethrough approximate a midpoint of the top wall; a cover hingedly connected to the top wall movable from a raised position to a closed position covering the hole; a light mounted on the front wall; a horn connected to the body; a pan removably disposed below the hole formed through the top wall; and a sensing mechanism, operationally connectable between the pan and the light and horn for activating the light and horn when a waste product is deposited within the pan.

19 Claims, 2 Drawing Sheets

COMBINED TOILET TRAINER AND TOY CAR

TECHNICAL FIELD

The present invention relates to devices for toilet training children and more particularly to devices for toilet training children that have a body that may be used as a toy car and a sensing mechanism for activating a horn and lights when a child uses the device as a toilet.

BACKGROUND ART

Many devices have been provided over the years for toilet training children. These devices commonly have a plastic shell which is shaped like a small commode or the like and either form a bowl or have a pan therein for containing the child's waste products. There are devices that have outer shells shaped like fire trucks and the such. While these devices provide a little more interest for a child than a standard commode, they do not provide the child with an interesting and fun device for learning how to use a toilet. In addition, once the child learns to use the toilet these devices become obsolete.

It would be a benefit, therefore, to have a device that is fun and interesting for a child to learn to use the toilet. It would be a further benefit to have a device that activates a horn and lights when a child successfully goes to the bathroom. It would be an additional benefit to have a device that can be used as a toy car to be driven by a child when not in use as a toilet trainer and after the child has learn to use the toilet.

GENERAL SUMMARY DISCUSSION OF INVENTION

It is thus an object of the invention to provide a combined toilet trainer and toy car that has a body shaped like an automobile having movable and steerable wheels.

It is a further object of the invention to provide a combined toilet trainer and toy car that has a removable pan held within the body for a child to use for toilet training.

It is a still further object of the invention to provide a combined toilet trainer and toy car that has lights and a horn in operational connection with the pan so that the lights and horn are activated when the child successfully goes to the bathroom.

Accordingly, a combined toilet trainer and toy car is provided of the type having a body constructed to resemble an automobile and ridable by a child and the body carrying a removable pan which activates a horn and lights when a child uses the pan as a toilet. The combined toilet trainer and toy car comprises: a body having a pair of side walls, a top wall, a front wall and a rear wall formed in the shape of an automobile, the top wall forming a hole therethrough approximate a midpoint of the top wall; a cover hingedly connected to the top wall movable from a raised position to a closed position covering the hole; a light mounted on the front wall; a horn connected to the body; a pan removably disposed below the hole formed through the top wall; and a sensing mechanism, operationally connectable between the pan and the light and horn for activating the light and horn when a waste product is deposited within the pan.

The body is constructed of a rigid material such as plastic or aluminum. Held within the interior of the body is a battery for operating the horn and lights. A pair of rear wheels and a pair of front wheels are rotatably connected to the body so that a child may sit atop the body and move it about. A steering column is connected to the front wheels so that the child can steer the car about.

The body may also include a front and rear bumper. Preferably, the bumpers are made of rubber so that the child does not damage the toy car or other property when playing with the car. The car may also have lights connected to the rear of the rear wall to simulate brake lights. The rear lights may further be operationally connected to the sensing mechanism.

The cover is hingedly connected to the top wall for covering the hole so that the child may sit atop the body and use the device as a toy car. The cover may also have a seat member connected to the top side of the cover so that when the cover is closed, the child has a place to sit.

The sensing mechanism may be any mechanism known in the art for activating the lights and horn when a child uses the toilet trainer. The sensing mechanism may include a lever type switch connected to the pan so that when the pan is weighted the switch is turned on. The sensing mechanism may include a spring disposed between a switch and the pan for supporting an empty pan above the switch.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
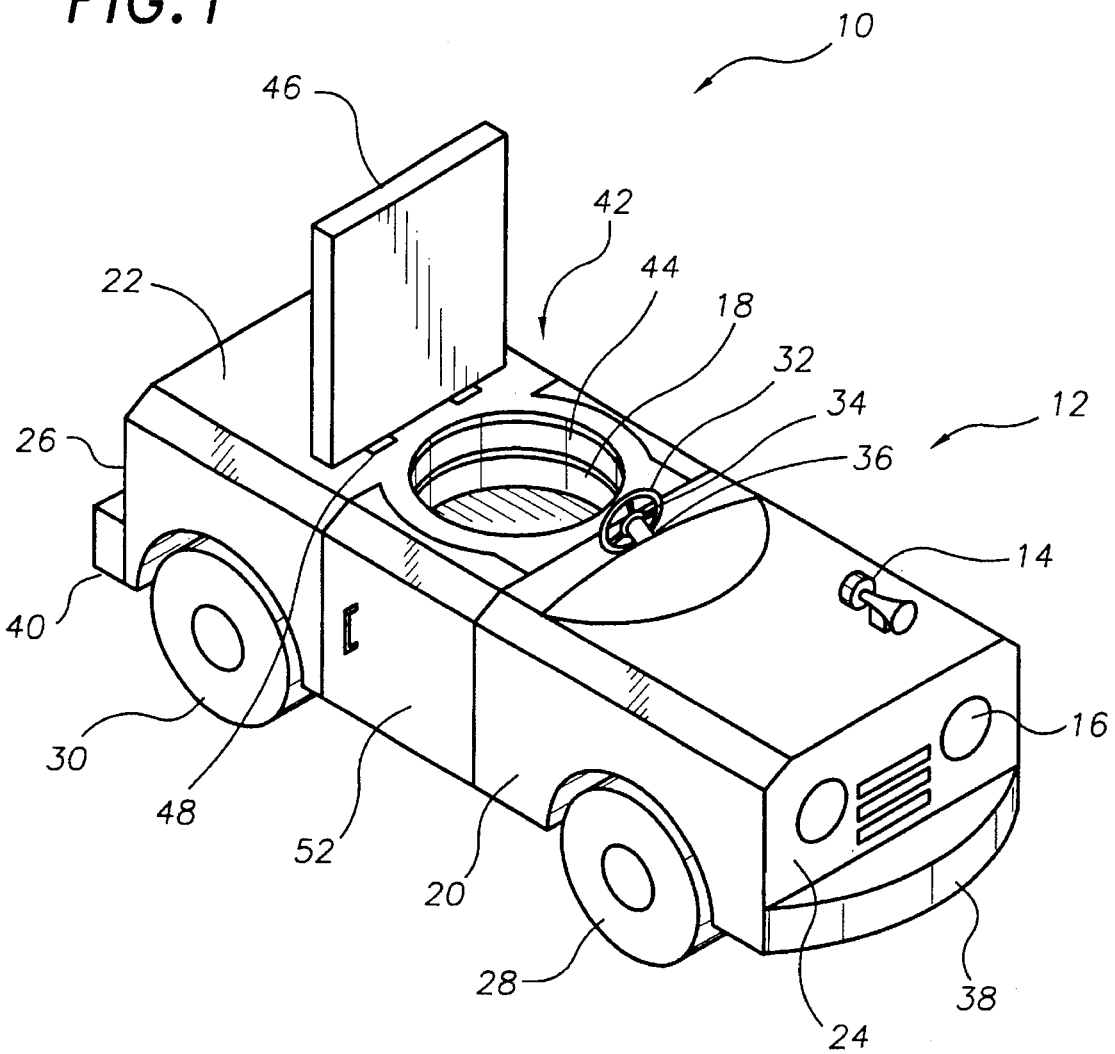
FIG. 1 is a perspective view of an exemplary embodiment of the combined toilet trainer and toy car.

FIG. 1 is a perspective view of an exemplary embodiment of the combined toilet trainer and toy car of the present invention generally designated by the numeral 10. Toilet trainer 10 includes a body 12 having an operational horn 14 and lights 16 and a pan 18 removably held within body 12. Pan 18 is operationally connectable to horn 14 and lights 16, such that, when waste products are deposited within pan 18, lights 16 and horn 18 are activated.

Body 12 is a unitary construction of molded plastic in the shape of an automobile. Body 12 includes a pair of side walls 20, a top wall 22, a front wall 24 and a rear wall 26.

Body 12 is mounted atop a front pair of ground engaging wheels 28 and a rear pair of ground engaging wheels 30. Rear wheels 30 are rotatably connected to an axle (not shown) connected to body 12. Front wheels 28 are rotatably connected to body 12.

A steering wheel 32 is connected to a first end 34 of a steering column 36, the second end (not shown) of steering column 36 is functionally connected to front wheels 28. Steering wheel 32 and steering column 36 are connected to front wheels 28 in a manner such that wheels 28 may be cooperatively turned directing the path of combined toilet trainer and toy car 10.

A rubber front bumper 38 is mounted longitudinally along the lower edge of front wall 24. A rubber rear bumper 40 is mounted longitudinally along the lower edge of rear wall 26.

Bumpers 38, 40 are provided to protect body 12 and furniture and walls from damage in a collision.

Lights 16 are mounted on front wall 24 and simulate automobiles headlights. Horn 14 is mounted atop top wall 22 adjacent front wall 24. Horn 14 and lights 16 are operationally connected to pan 18 in a manner hereinafter to be described.

Top wall 22 forms a substantially circular hole 42 therethrough approximate the midpoint thereof. Pan 18 is concentrically aligned and removably held below hole 42 by a bracket 44 for containing human waste when used as a toilet. Each side wall 20 has a movable door 50 connected thereto adjacent hole 42.

A cover 46 is hingedly mounted on top wall 22 by hinges 48 for covering hole 42 when not in use as a toilet. As shown in FIG. 1, cover 46 is raised for using combined toilet trainer and toy car 10 as a toilet.

Figure 2:
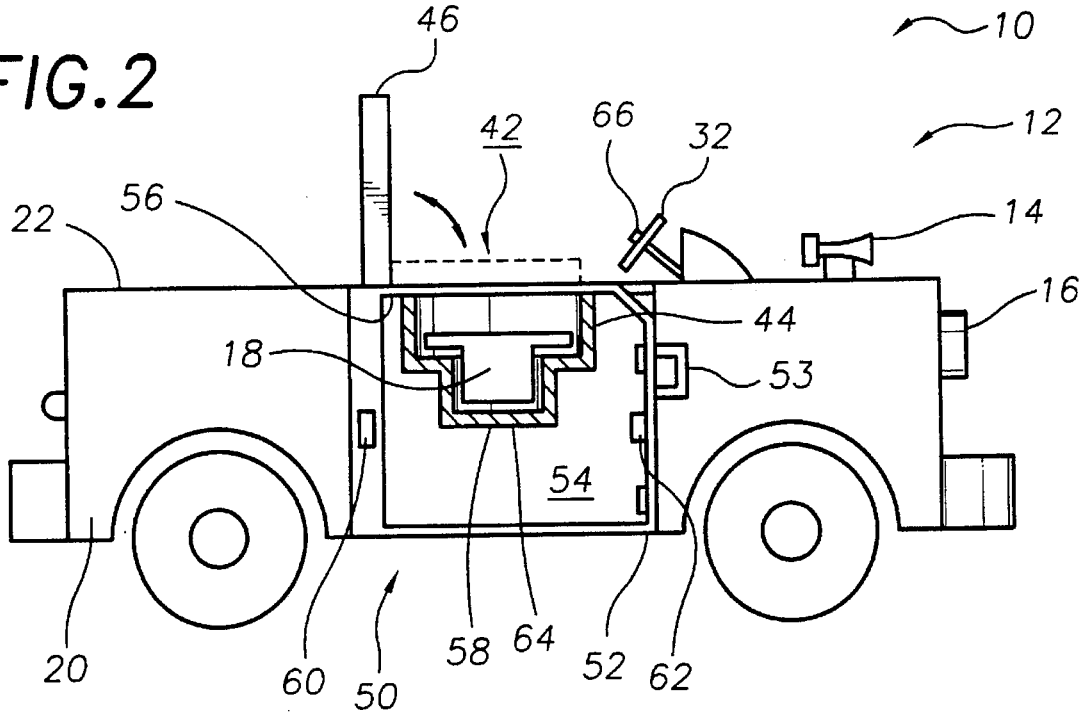
FIG. 2 is a side view of the combined toilet trainer and toy car.

FIG. 2 is a side view of combined toilet trainer and toy car 10. As shown in FIG. 2, each side wall 20 forms an aperture 50 for accessing the interior 54 of body 12 to dispose pan 18 therein or remove pan 18 therefrom. FIG. 2 further shows cover 46 in the raised position for using combined toilet trainer and toy car 10 as a toilet trainer and movable to a closed position indicated by the hidden lines for using combined toilet trainer and toy car 10 as a toy car.

A door 52 is hingedly connected to each side wall 20 for moving between an open position as shown in FIG. 2 for accessing interior 54 and a closed position shown in FIG. 1 covering aperture 50. A locking mechanism, comprising a metal plate 60 and a magnet 62, is connected between door 52 and body 12 for maintaining door 52 in a closed position. A handle 53 is connected to door 52 for moving door 52 from the closed to open position and vice versa.

Pan 18 is removably held within a bracket assembly 44 disposed below hole 42 formed through top wall 22. Bracket assembly 44 is connected to the interior surface 56 of top wall 22. A pressure sensitive switch assembly 58 disposed between a floor member 64 of bracket 44 and pan 18. Pressure sensitive switch assembly 18 is in operational connection between pan 18 and horn 14 and lights 16 via a battery (not shown) by unlabeled wires when pan 18 is disposed within bracket assembly 44.

Combined toilet trainer and toy car 10 further includes a horn switch 66 mounted atop steering wheel 32. Horn switch 66 is operationally connected to horn 14 via a battery by unlabeled wires for selectively operating horn 14.

Figure 3:
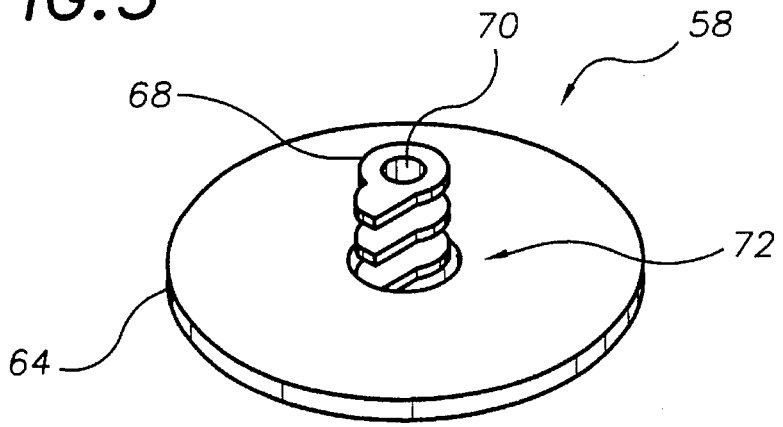
FIG. 3 is a perspective view of the pressure sensitive switch assembly in isolation.

FIG. 3 is a perspective view of pressure sensitive switch assembly 58 in isolation. Pressure sensitive switch assembly 58 includes a helical spring 68 and a button switch 70. Switch 70 is mounted within a recess 72 formed by floor member 64. Spring 68 is disposed about switch 70 and into recess 72. Spring 68 has a spring constant sufficient to urge pan 18 when empty away from switch 70 shown in FIG. 2.

It can be seen from the preceding description that a device for toilet training children which has a body shaped like an automobile having movable and steerable wheels, has a removable pan held within the body for a child to use for toilet training, and has lights and a horn in operational connection with the pan so that the lights and horn are activated when the child successfully goes to the bathroom has been provided.

It is noted that the embodiment of the combined toilet trainer and toy car described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A combined toilet trainer and toy car comprising:

a body having a pair of side walls, a top wall, a front wall and a rear wall formed in the shape of an automobile, said top wall forming a hole therethrough approximate a midpoint of said top wall;

a cover hingedly connected to said top wall, said cover being movable from a raised position to a closed position covering said hole;

a light mounted on said front wall;

a horn connected to said body;

a pan removably disposed below said hole formed through said top wall; and sensing means, operationally connectable between said pan and said light and said horn for activating said light and said horn when a waste product is deposited within said pan; and, a bracket assembly having a floor member for removably holding said pan, said bracket assembly being connected to an interior surface of said top wall.

2. The combined toilet trainer and toy car of claim 1, wherein:

said sensing means includes a pressure sensitive switch operatively connected to said horn and said lights.

3. The combined toilet trainer and toy car of claim 2, further including:

a pair of rear ground engaging wheels rotatably connected to said body; and a pair of front ground engaging wheels rotatably connected to said body.

4. The combined toilet trainer and toy car of claim 3, further including:

a steering column having a first end and a second end; and a steering wheel connected to said first end of said steering column;

said second end of said steering column being functionally connected to said front wheels in a manner such that said front wheels may be cooperatively turned.

5. The combined toilet trainer and toy car of claim 4, wherein:

each said side wall forms an aperture therethrough for accessing an interior defined by said body to dispose said pan therein or remove said pan therefrom;

said combined toilet trainer and toy car further including:

a door hingedly connected to each said side wall, said doors being movable from an open position for accessing said interior of said body to a closed position covering said aperture formed through said side wall; and a locking mechanism in connection between said door and said body for retaining said door in said closed position.

6. The combined toilet trainer and toy car of claim 5, further including:

a front bumper connected to said front wall; and a rear bumper connected to said rear wall.

7. The combined toilet trainer and toy car of claim 1, wherein:

said sensing means includes a pressure sensitive switch operatively connected to said horn and said lights, said pressure sensitive switch being connected to said floor member of said bracket assembly.

8. The combined toilet trainer and toy car of claim 7, wherein:

said sensing means includes a spring disposed about said pressure sensitive switch for urging said pan away from said switch when said pan is empty.

9. The combined toilet trainer and toy car of claim 1, further including:

a pair of rear ground engaging wheels rotatably connected to said body; and a pair of front ground engaging wheels rotatably connected to said body.

10. The combined toilet trainer and toy car of claim 9, further including:

a steering column having a first end and a second end; and a steering wheel connected to said first end of said steering column;

said second end of said steering column being functionally connected to said front wheels in a manner such that said front wheels may be cooperatively turned.

11. The combined toilet trainer and toy car of claim 1, further including:

a front bumper connected to said front wall; and a rear bumper connected to said rear wall.

12. The combined toilet trainer and toy car of claim 1, wherein:

each said side wall forms an aperture therethrough for accessing an interior defined by said body to dispose said pan therein or remove said pan therefrom; and said combined toilet trainer and toy car further includes a door hingedly connected to each said side wall, said doors being movable from an open position for accessing said interior of said body to a closed position covering said aperture formed through said side wall.

13. The combined toilet trainer and toy car of claim 12, further including:

a locking mechanism in connection between said door and said body for retaining said door in said closed position.

14. The combined toilet trainer and toy car of claim 1, further including:

a horn switch operationally connected to said horn for selectively operating said horn.

15. A combined toilet trainer and toy car comprising:

a body having a pair of side walls, a top wall, a front wall and a rear wall formed in the shape of an automobile, said top wall forming a hole therethrough approximate a midpoint of said top wall, and each said side wall forming an aperture therethrough for accessing an interior defined by said body;

a pan removably disposed below said hole formed through said top wall;

a cover hingedly connected to said top wall, said cover being movable from a raised position to a closed position covering said hole;

a door hingedly connected to each said side wall, said door being movable from an open position for accessing said interior of said body to a closed position covering said aperture formed through said side wall;

a pair of rear ground engaging wheels rotatably connected to said body;

a pair of front ground engaging wheels rotatably connected to said body;

a steering column having a first end and a second end, said second end of said steering column being functionally connected to said front wheels in a manner such that said front wheels may be cooperatively turned;

a steering wheel connected to said first end of said steering column for turning said front wheels;

a light mounted on said front wall;

a horn connected to said body; and sensing means, operationally connectable between said pan and said light and said horn for activating said light and said horn when a waste product is deposited within said pan; and, a bracket assembly having a floor member for removably holding said pan, said bracket assembly being connected to an interior surface of said top wall.

16. The combined toilet trainer and toy car of claim 15, wherein:

said body includes a bracket assembly connected thereto for removably holding said pan; and said sensing means includes a pressure sensitive switch operatively connected to said horn and said lights, said pressure sensitive switch being connected to said bracket.

17. The combined toilet trainer and toy car of claim 16, wherein:

said sensing means further includes a spring disposed about said switch in a manner such that said spring urges said pan away from said switch when said pan is empty.

18. The combined toilet trainer and toy car of claim 17, further including:

a horn switch operationally connected to said horn for selectively operating said horn;

a front bumper connected to said front wall; and a rear bumper connected to said rear wall.

19. A combined toilet trainer and toy car comprising:

a body having a pair of side walls, a top wall, a front wall and a rear wall formed in the shape of an automobile, said top wall forming a hole therethrough approximate a midpoint of said top wall, and each said side wall forming an aperture therethrough for accessing an interior defined by said body;

a cover hingedly connected to said top wall, said cover being movable from a raised position to a closed position covering said hole;

a door hingedly connected to each said side wall, said door being movable from an open position for accessing said interior of said body to a closed position covering said aperture formed through said side wall;

a pair of rear ground engaging wheels rotatably connected to said body;

a pair of front ground engaging wheels rotatably connected to said body;

a steering column having a first end and a second end, said second end of said steering column being functionally connected to said front wheels in a manner such that said front wheels may be cooperatively turned;

a steering wheel connected to said first end of said steering column for turning said front wheels;

a front bumper connected to said front wall;

a rear bumper connected to said rear wall a light mounted on said front wall;

a horn connected to said body;

a horn switch operationally connected to said horn via a battery for selectively operating said horn;

a pan removably held by said bracket assembly disposed below said hole formed through said top wall;

a bracket assembly having a floor member for removably holding said pan, said bracket assembly being connected to an interior surface of said top wall;

a pressure sensitive switch disposed between said bracket assembly and said pan, said pressure sensitive switch being operationally connectable between said pan and said light and said horn in a manner such that when a waste product is deposited within said pan said horn and said light are activated; and a spring disposed about said pressure sensitive switch in a manner such that said pan is urged away from said pressure sensitive switch when said pan is empty.

* * * * *